US006629019B2

(12) United States Patent
Legge et al.

(10) Patent No.: US 6,629,019 B2
(45) Date of Patent: Sep. 30, 2003

(54) ACTIVITY MANAGEMENT SYSTEM

(75) Inventors: John V. Legge, Orange, CA (US); Robert Lasnik, Yorba Linda, CA (US)

(73) Assignee: Amusement Soft, LLC, Orange, CA (US)

( * ) Notice: Subject to any disclaimer, the term of this patent is extended or adjusted under 35 U.S.C. 154(b) by 106 days.

(21) Appl. No.: 09/756,380

(22) Filed: Jan. 8, 2001

(65) Prior Publication Data

US 2002/0090992 A1 Jul. 11, 2002

Related U.S. Application Data

(60) Provisional application No. 60/233,347, filed on Sep. 18, 2000.

(51) Int. Cl.[7] ..... G07C 9/00

(52) U.S. Cl. ..... 700/237; 463/25; 235/375; 235/380; 235/381

(58) Field of Search ..... 463/25, 17–22, 463/29; 273/143 R; 342/51, 42, 44; 235/375, 380, 381, 382, 383; 700/231–232, 237, 241, 244

(56) References Cited

U.S. PATENT DOCUMENTS

| | | | | | |
|---|---|---|---|---|---|
| 4,032,946 | A | * | 6/1977 | Wakatsuki et al. | 364/900 |
| 4,575,622 | A | * | 3/1986 | Pellegrini | 235/382 |
| 5,326,104 | A | * | 7/1994 | Pease et al. | 273/138 A |
| 5,496,032 | A | * | 3/1996 | Okada | 273/138 A |
| 5,640,002 | A | * | 6/1997 | Ruppert et al. | 235/472 |
| 5,779,546 | A | * | 7/1998 | Meissner et al. | 463/25 |
| 5,902,983 | A | * | 5/1999 | Crevelt et al. | 235/380 |
| 5,954,583 | A | * | 9/1999 | Green | 463/29 |
| 6,068,192 | A | * | 5/2000 | McCabe et al. | 235/487 |
| 6,165,069 | A | * | 12/2000 | Sines et al. | 463/12 |
| 6,263,316 | B1 | * | 7/2001 | Khan et al. | 705/13 |
| 6,409,595 | B1 | * | 6/2002 | Uihlein et al. | 463/29 |
| 6,424,884 | B1 | * | 7/2002 | Brooke, Jr. et al. | 700/232 |

OTHER PUBLICATIONS

Business News From Philips Semiconductors, Contactless Smart Cards for Electronic Toll Collectin in Malaysia, 1999.*

RePlay Magazine, Taking Control, pp. 117–118, Dec. 1999.*

(List continued on next page.)

*Primary Examiner*—S. Thomas Hughes
*Assistant Examiner*—Carmen D. White

(57) ABSTRACT

An activity management system for coin-operated systems including but not limited to video arcade games and slot machines utilizes an automated redemption system comprising a client transponder card with a memory unit, an activity station, a management station, and an attendant transponder with a memory unit. The client transponder card stores event criteria such as a debit/credit indicator, a content rating and a time stamp. The attendant transponder has a passkey and a debit/credit indicator. The activity station has an inductive transmission system and programs for evaluating the client transponder's event criteria and for interacting with the attendant transponder's passkey and debit/credit indicator. The management station has a computer with a database and an inductive transmission system for reading and writing data to client transponder cards. The management station has a wireless data connection with the activity stations and periodically queries the activity stations for data.

27 Claims, 4 Drawing Sheets

OTHER PUBLICATIONS

Excerpts, Phillip Semiconductors Web site, I–CODE–Transponder ICs, 2001.*
Texas Instruments' Product Bulletin, Tag–It Inlays, May 2000.*
Zeus Transceiver User's Manual, Chapter 1: Overview, pp. 1–8.*
RetailTech Magazine, pp. 1–2, May 2000.*
Product Sheet: FEIG Electronic, i–Scan, Installation Manual, pp. 2–7, 1999.*
Product Sheet: FEIG Electronic, i–Scan, System–Manual, 1998.*
Product Sheet: AMD, Am29F400B, Distinctive Characteristics, Pub No. 21505, Nov. 1999.*
Product Sheet: AMD, Am186 ES/ESLV and Am188 ESLE-SLV, Distinctive Characteristics, Pub No. 20002, Feb. 1997.*
Product Sheet: Dallas Semiconductor, Trickle Charge Timekeeping Chip, 2 pages.*

* cited by examiner

ACTIVITY MANAGEMENT SYSTEM

This patent application claims priority based on provisional patent application U.S. Serial No. 60/233,347 filed on Sep. 18, 2000.

TECHNICAL FIELD

The present invention is an activity management system, in particular for coin-operated systems including but not limited to video arcade games and slot machines.

BACKGROUND ART

Casino gambling and video game arcades are substantial industries. These industries frequently use machines that are coin or token-operated including but not limited to video arcade games and slot machines. These machines can require the accounting, maintenance and security of large sums of coins and other currency. These machines also often require a user to return to a central location to acquire tokens, coins or change for bills.

A number of prior art gaming systems are known including but not limited to U.S. Pat. Nos. 4,575,622, 4,032,946, 5,326,104, 5,496,032, and 5,779,546. However, these systems can be cumbersome, expensive, limited in application, or do not address each of the issues above.

Thus, there is a need for an activity management system that facilitates the accounting, maintenance and security of large sums of coins or other currency and that does not require the user to leave his or her machine to return to a central location to acquire tokens, coins, or change for bills.

SUMMARY OF THE INVENTION

The present invention is an activity management system, in particular for coin-operated systems including but not limited to video arcade games and slot machines. The preferred embodiment of the activity management system is an automated redemption system comprising a client transponder card with a memory unit, an activity station, a management station, and an attendant transponder with a memory unit. The memory unit of the client transponder card preferably has event criteria such as a debit/credit indicator, a content rating and a time stamp. The memory unit of the attendant transponder preferably has a passkey and a debit/credit indicator. The preferred embodiment of the activity station has an inductive transmission system, a memory unit with programs for evaluating the client transponder's event criteria such as the debit/credit indicator, content rating and/or time stamp and programs for interacting with the attendant transponder's passkey and debit/credit indicator. The preferred embodiment of the activity station also has three status indicating lights and an alphanumeric display. The preferred embodiment of the management station has a computer with a database and a management station inductive transmission system for reading and writing data to client transponder cards. The management station preferably has a wireless network data connection with the activity station via transceivers in each station. The management station periodically queries the activity station for data.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide an activity management system.

Figure 1:
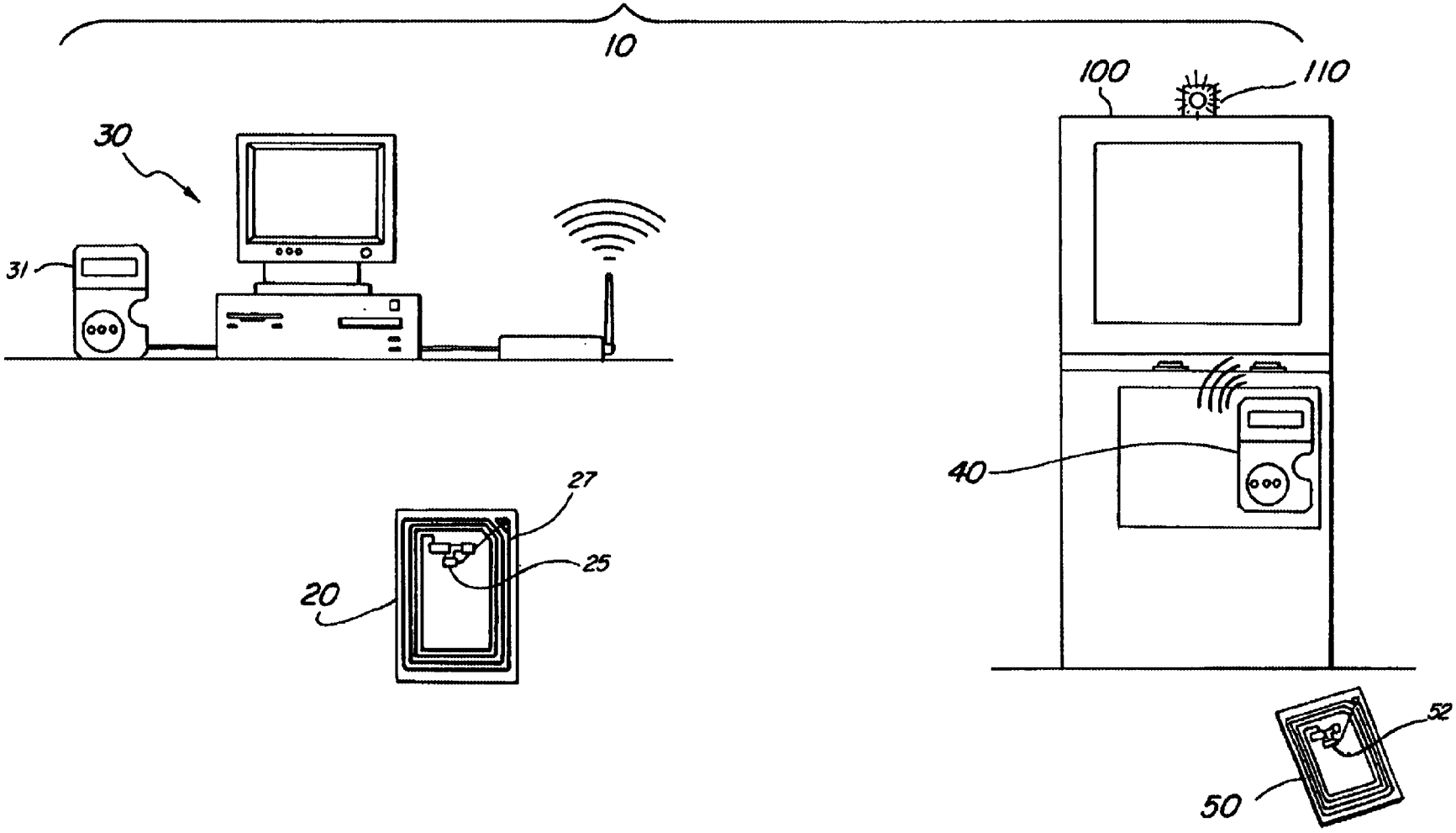
FIG. 1 is a diagram of a preferred embodiment of the system.

Referring now to FIG. 1, a preferred embodiment of an activity management system 10 is shown comprising a client transponder card 20, a management station 30, and an activity station 40 connected to a coin mechanism of a coin-operated machine 100. The client transponder card 20 is preferably issued from the management station 30. An attendant transponder 50 is also shown.

Figure 2:
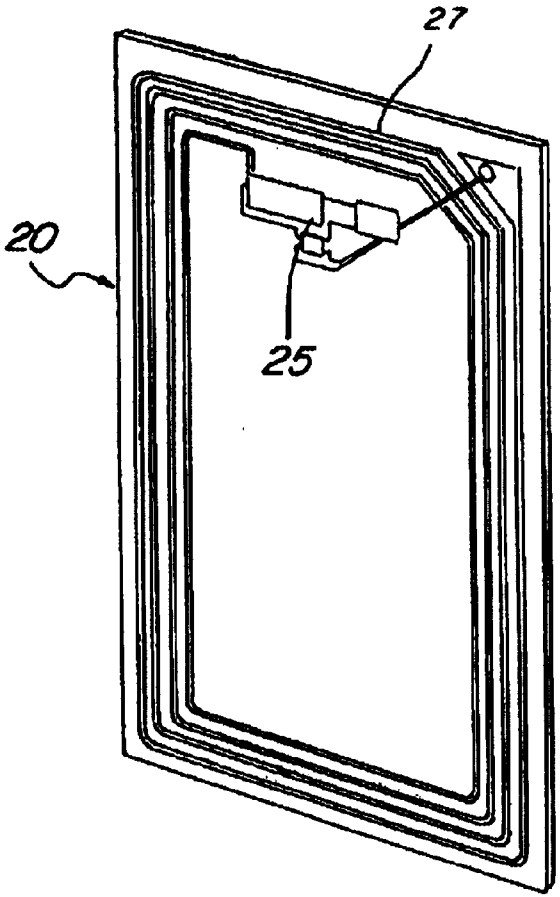
FIG. 2 is a perspective view of a preferred embodiment of a client or attendant transponder card.

Referring now to FIG. 2, the preferred embodiment of the client transponder card 20 has a memory unit 25 and an antenna 27. Preferably, the client transponder card 20 is a passive, battery-less transponder and the memory unit 25 is a 512-bit non-volatile user memory with read/write capability. The memory unit 25 is programmable and can be locked to protect data from modification. Preferably, the client transponder card 20 is thin, approximately 0.085 mm to 0.355 mm thick. The transponder is placed on a polymer tape substrate. The preferred embodiment of the client transponder card 20 is a Philips I Code 1 RFID IC with a 13.56 Mhz operating frequency. Alternatively, a Texas Instruments' Tag-it™ TIRIS transponder can be used.

The client transponder card 20 is shown uncovered in FIG. 2. The client transponder card can fit between layers of laminated paper or plastic such as stickers, labels, tickets and/or badges. The client transponder card 20 can additionally have magnetic stripes, bar codes or other printed information such as optical and/or holographic printing.

The client transponder is shown in its preferred embodiment on a card. However, other shapes and placement are possible due to the relatively small size of the client transponder. For example, the client transponder can be placed on, inter alia, a wand, a key holder, and clothing. The client transponder could also be placed subcutaneously on a customer.

The client transponder 20 has a preferable operating/detection range of 1.5 meters. However, the range is preferably tuned down to 50 millimeters so that inadvertent detections are not generated by other client transponders within range of an activity station 40.

The memory unit 25 of the client transponder card 20 preferably contains data establishing event criteria including, inter alia, a debit/credit indicator, a content rating, a time stamp, and/or an age and/or height restriction.

The attendant transponder 50 preferably has the same components as the client transponder 20. However, as shown below, the attendant transponder 50 has different data loaded into the memory unit 52.

Figure 3:
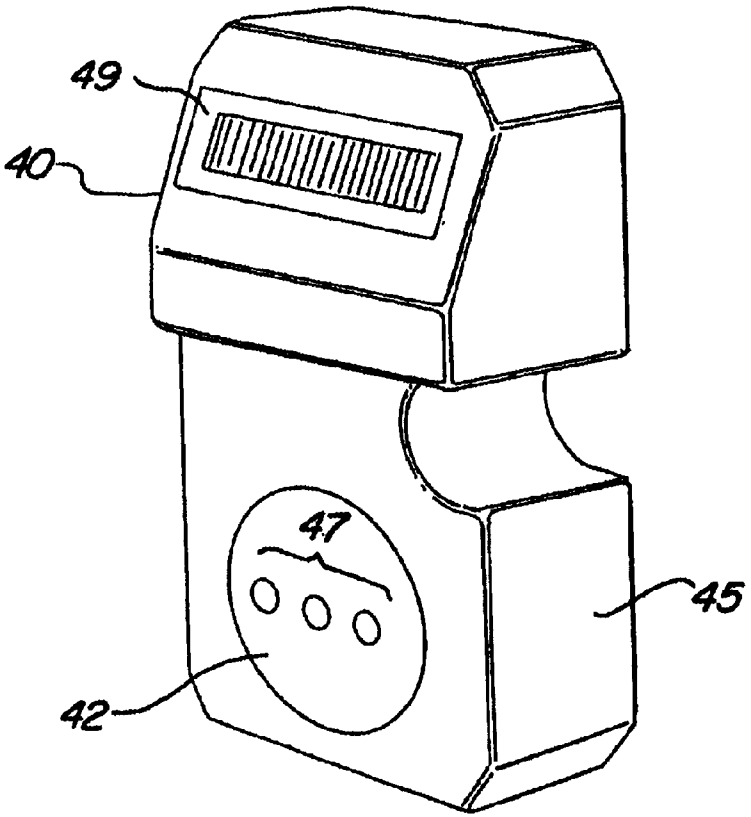
FIG. 3 is a perspective view of a preferred embodiment of an activity station.
Figure 5:
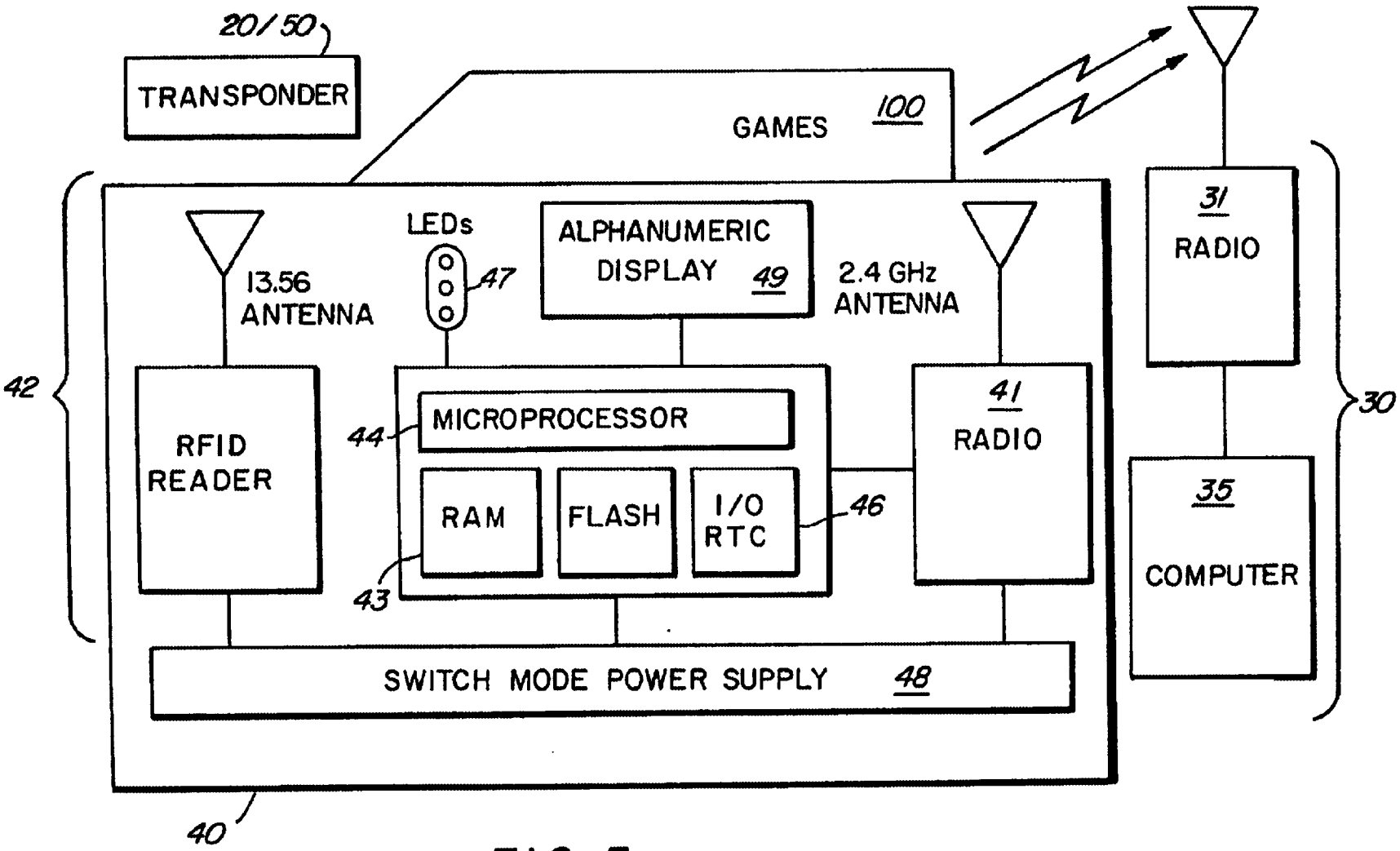
FIG. 5 is a block diagram of a preferred embodiment of an activity station.

Referring now to FIG. 3, a preferred embodiment of the activity station 40 is shown. The activity station 40 has a casing 45 supporting an inductive transmission system 42, a "traffic light protocol," i.e. red, yellow, and green, set of status indicating lights 47, and an alphanumeric display 49. Referring now to FIG. 5, the activity station 40, also, preferably, has a transceiver 41, a memory unit 43, a micro-controller 44, a time-keeping chip 46 and a power supply 48.

The preferred embodiment of the inductive transmission system 42 is an OBID i-scan® ID ISCM01-A/B inductive transmission system manufactured by FEIG Electronic GmbH. The inductive transmission system 42 enables contact-less identification of objects including but not limited to the client transponder card 20. The components of the system 42 enable users to write on the client transponder card 20 and to read it. The system 42 has a reader, an antenna and a transponder to store data. Preferably, the system 42 can read and write on different transponder types such as a client transponder card 20 and an attendant transponder 50.

The preferred embodiment of the memory unit 43 is a 4 Megabit CMOS 5.0 Volt-only Boot Sector Flash Memory and 4 Mega-bits of static RAM. An AMD®Am29F400B is preferred for the flash memory. The memory unit preferably contains various software programs. The programs control the inductive transmission system 42, evaluate event criteria read from the client transponder card 20, authenticate client transponder cards 20 and attendant transponders 50, perform diagnostic and status checks of the activity station 40 and the activity management system 10, manipulate the debit/credit indicator on the client transponder card 20, and secure stored data with a passkey program.

The preferred embodiment of the time-keeping chip 46 is a Dallas Semiconductor DS1302 Trickle Charge Timekeeping Chip. The preferred time-keeping chip 46 has a real time clock/calendar and 31 bytes of static RAM. The time-keeping chip 46 communicates with the microcontroller 44 with a simple serial interface. Preferably, the time-keeping chip provides seconds, minutes, hours, day, date, month and year information. The end of the month date is automatically adjusted for months with less than 31 days, including corrections for leap year. The time-keeping chip operates in either the 24-hour or 12-hour format with an AM/PM indicator. The time-keeping chip 46 is also preferably connected to a battery. The battery is useful in maintaining the time-keeping function for if and when the activity station 40 loses power.

The preferred embodiment of the alphanumeric display 49 is a 5×7 Dot Character Vacuum Fluorescent Display ("VFD") manufactured by Noritake Co., Inc. The preferred display 49 has two rows of twenty characters each (2×20), 9 mm high, and can show a variety of letters, numbers, characters and symbols.

The preferred embodiment of the microcontroller 44 is an AMD® Am186™ ES. The microcontroller 44 is connected to and controls the "traffic light protocol" set of status indicating lights 47, the alphanumeric display 49, and the inductive transmission system 42 based on data and instructions from the time-keeping chip 46 and the memory unit 43.

The preferred embodiment of the transceiver 41 is a ZEUS™ Model ZLRT2100 stand-alone transceiver. The preferred transceiver uses Frequency Hopping Spread Spectrum (FHSS) technology for security and reliability of longer range transmissions. The transceiver 41 preferably operates in the 2.4 Ghz frequency band. The transceiver 41 creates a wireless network data connection with a transceiver 31 in the management station 30. The transceiver 41 can use a variety of network protocols to communicate with other transceivers including but not limited to a serial asynchronous protocol using both TTL and RS 232 levels. Other network protocols used in both wireless and wired networks are usable such as TCP/IP and IPX. The transceiver 41 also preferably has error detection and correction algorithms. The preferred range of the transceiver 41 is 1500 feet. However, a set of repeaters can extend the signal range up to four times to 6,000 feet.

A wireless network data connection is preferred but not required. A wired network data connection may be desirable for, inter alia, security reasons or to connect to other pre-existing data networks.

The activity station 40 can be connected to a coin mechanism of a coin-operated machine 100 such as a video arcade game or slot machine. The most common prior art coin mechanism generates a coin pulse of a predetermined pulse width, usually 10–30 milliseconds, to activate the machine 100. The activity station 40 can be adjusted to operate, activate or emulate coin mechanisms that generate a variety of pulse widths.

The activity station 40 can also be connected to an automated ticket dispenser. Automated ticket dispensers are often found in video arcades. The ticket dispenser dispenses tickets for redemption. The tickets can usually be redeemed for various prizes. The activity station 40 can control, dispense and account for tickets from the ticket dispenser.

Figure 4:
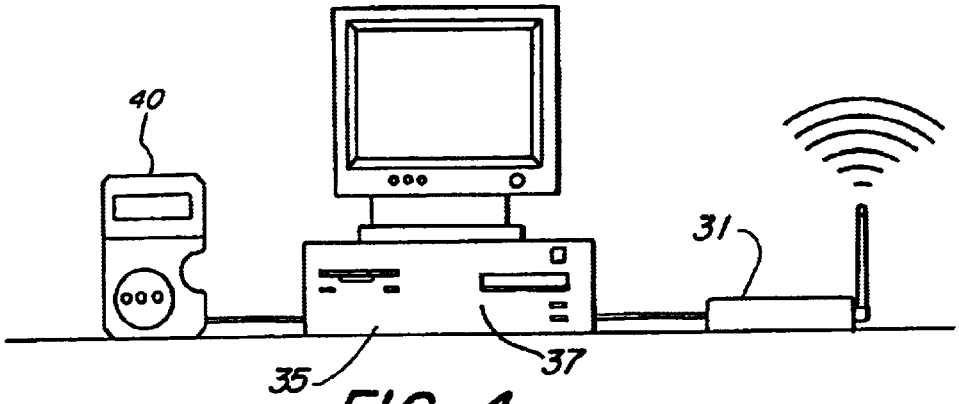
FIG. 4 is a front view of a preferred embodiment of a management station.

Referring now to FIG. 4, the preferred embodiment of the management station 30 has a computer 35 with a memory and storage unit 37, such as a personal computer. The computer 35 preferably has automatic redemption system software loaded such as ARS 2000™ by Amusement Soft LLC, a database for accounting and management of a plurality of machines 100 and/or activity stations 40. The management station 30 has an inductive transmission system 32 for reading and writing on client transponder cards 20 and attendant transponders 50. The management station 30 also has the transceiver 31 as described above for its wireless network data connection with at least one activity station 40. The management station 30 can preferably control up to 238 activity stations 40 from a central location.

Figure 6:
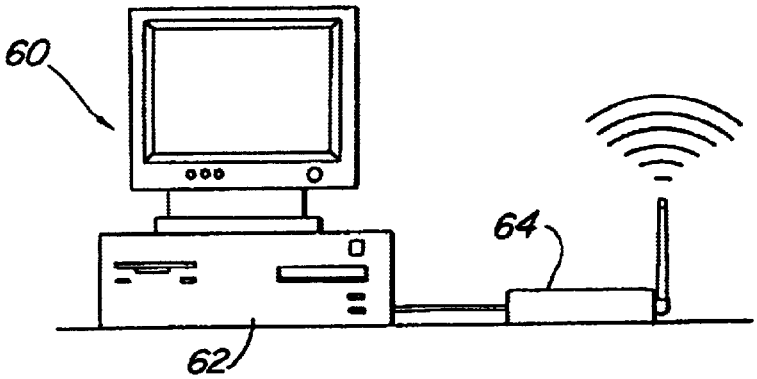
FIG. 6 is a front view of a preferred embodiment of a monitoring station.
Figure 7:
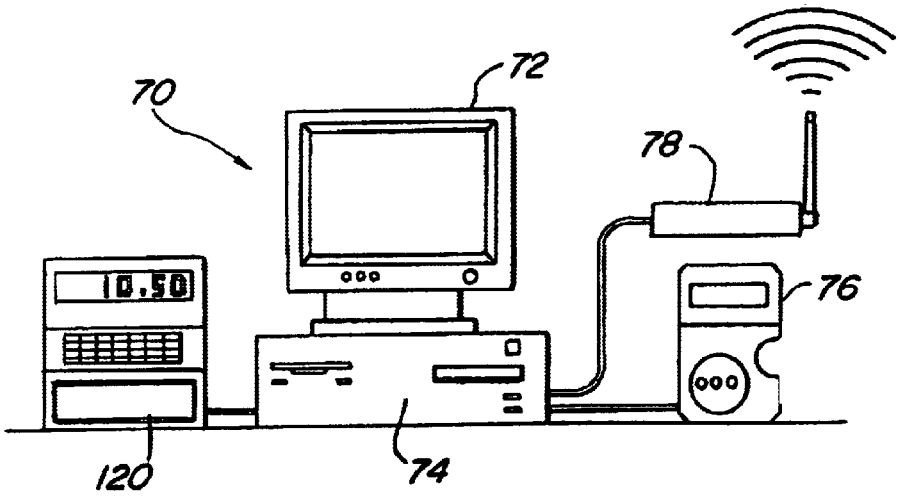
FIG. 7 is a front view of a preferred embodiment of a till station.

The management station 30 can be separated into two separate stations, a monitoring station 60 and a till station 70. See FIGS. 6 and 7. The monitoring station 60 preferably has a computer 62, preferably a personal computer, and a transceiver 64 to maintain a wireless network data connection with up to 238 activity stations 40 from a central location. The monitoring station 60 monitors each of the activity stations 40 for, inter alia, security and maintenance purposes. The monitoring station 60 also communicates by wired, or wireless connection via the transceiver 64, with the till station 70.

The till station 70 preferably comprises a computer 72 with a memory and storage unit 74, such as a personal computer; and an inductive transmission system 76 for reading and writing client transponder cards 20 and attendant transponders 50. The till station 70 also preferably has a network data connection with the monitoring station 60, either wired or wireless via a transceiver 78. The computer 72 preferably maintains the automatic redemption system software for accounting and management of the plurality of machines 100 and/or activity stations 40. The till station 70 is preferably maintained where currency is collected from customers, client transponders 20 are issued, and accounting of currency and transponders 20 can be input directly into the till station 70. The till station 70 is preferably connected to a cash register 120 or some other type of currency till. These separate stations 60 and 70 may be desirable when extra security is desired for the till station 70 and the currency collected by it.

The activity management system 10 is used as an automated redemption system as follows: A customer obtains a client transponder card 20, preferably from the management station 30. Event criteria are placed on the client transponder card 20 by the management station's inductive transmission system 31. For example, the customer can purchase credits for gaming.

Furthermore, a content rating can be placed on the client transponder card 20 to limit a customer's access to violent, adult or otherwise inappropriate gaming systems in the system 10.

A time stamp can also be used as an event criterion. For example, a special game play rate might be in effect for a predetermined period of time. (e.g. An introductory 1 hour period of 25 cents vs. 1 dollar per game play.) Also, the time stamp and/or the time-keeping chip 46 can be used to enforce a curfew on minor customers. Alternatively, the time stamp could indicate an expiration date for credits on the client transponder 20, e.g. "This card not usable after Jan. 1, 2002." The time stamp could also indicate that a client transponder 20 is only usable for a specified period of time from activation (e.g. one hour) on any future date. Age restrictions and height restrictions are also possible event criterion.

Once the management station 30 prepares the client transponder card 20, the customer can take the card 20 to an activity station 40. As stated above, the activity station 40 can be connected to the coin mechanism of a coin-operated machine such as a video game or a slot machine.

The customer waves the client transponder card 20 in front of the inductive transmission system 42 (FIG. 5) of the activity station 40. If the card 20 is close enough to the system 42, the system 42 will activate the client transponder card 20 and read it. The alphanumeric display and the status lights 47 will indicate to the customer whether the client transponder card 20 has been read. The alphanumeric display 49 can indicate, inter alia, to the customer how many debits/credits are left on the card 20, any event criteria on the card 20, the time, and the cost of game play. The status lights 47, for example, can flash red for a waiting state, yellow to indicate detection of a transponder by the inductive transmission system 42, and green for credits deducted and game and/or machine 100 activated. The status lights 47 are useful for indicating the status of the activity station 40 to customers unable to read the alphanumeric display 49 such as younger customers or customers that do not speak the language displayed.

The activity station 40 will evaluate the event criteria, if any, on the card 20 for restrictions and the number of debits/credits available on the card 20. The customer will then have the opportunity to remove credits from his/her client transponder card 20 to activate the machine 100. If the event criteria permit and the proper credits are available, the activity station 40 will activate the coin mechanism of the machine 100 for game play.

Once game play has begun, a customer can, preferably, remain at the machine 100. If the client transponder card 20 has insufficient credits for continued game play, the customer can notify an attendant verbally or with a call button. Alternatively, an activity station 40 can monitor the number of debits/credits on a client transponder card 20 and if the debits/credits indicator is below a predetermined level, the management station 30 can be notified to send an attendant to the activity station 40 to ask the customer if he/she wishes to purchase more debits/credits. The attendant will, preferably, have an attendant transponder 50. The attendant can collect money from the customer to purchase more credits. The attendant can also pay out winnings, if any. A customer is, therefore, likely to remain longer at the machine 100.

The attendant transponder 50 can be used in a variety of ways. Preferably, an attendant transponder 50 has a debit/credit indicator in its memory unit 52. The debit/credit indicator is preset at the management station 30 with a predetermined number of credits when the attendant transponder is issued. The attendant can then collect money in exchange for issuing credits to customers. This allows for a controlled accounting of credits and/or currency.

For example, an attendant can begin with $100 in credits on the attendant transponder 50. If the attendant issues $60 in credits from the attendant transponder 50, when the attendant returns to the management station 30, the attendant will return $60 in currency to the management station and an attendant transponder with $40 in credits.

Alternatively, a three card configuration of the attendant transponder 50 can be used. The three card configuration can have security and accounting benefits. In this embodiment, an attendant carries three attendant transponder cards: a denomination card, a cash control card, and a supervisor data card. Each one of these cards is structured like the attendant transponder card 50. The cash control card is used to carry credits just as the attendant transponder 50 is described above. As above, the attendant can begin with a pre-determined number of credits on the cash control card.

When the attendant wishes to issue credits to a client transponder 20, the attendant first waves the denomination card in front of the inductive transmission system 42 on the activity station 40. The denomination card indicates how many credits will be removed from the cash control card with each wave. For example, the denomination card can indicate that $1, $5, $10 or $100 should be removed from the cash control card each time the cash control card is waved before the inductive transmission system 42.

Next, the attendant waves the cash control card in front of the inductive transmission system 42 on the activity station 40 to remove credits from the cash control card. Finally, the client transponder card 20 is waved in front of the inductive transmission system 42 to write the credits from the cash control card onto the client transponder 20.

A supervisor data card is used to read data from the activity station 40. The supervisor data card can cause the activity station 40 to read out data on the alphanumeric display 49. Alternatively, the activity station 40 can write collected data to the supervisor data card via the inductive transmission system 42.

As another alternative, the attendant transponder 50 can operate as a passkey to release credits from an activity station 40. To place or re-place credits on the client transponder card 20, the attendant transponder 50 has a passkey in its memory unit 52. The activity station 40 recognizes the passkey as belonging to an attendant transponder 50. The attendant can collect money from the customer and then indicate how many credits to place on the client transponder card 20 by waving the attendant transponder 50 before the activity station 40 in range of the inductive transmission system 42. The client transponder card 20 is then placed in range of the inductive transmission system 42 of the activity station 40 so that the debit/credit event criterion can be written or re-written. Of course, the customer can always return to the management station 30 to purchase more credits or collect winnings, if any, as well. The activity station 40 maintains an accounting of the credits issued from it and communicates that data to the management station 30 in real time or periodically via the network data connection.

During game play or other idle times when the activity station 40 is not in active use, the management station 30 can collect data from the activity station 40 for the database and/or the automated redemption system software for management, security, and/or accounting purposes over the wireless network data connection between the management station transceiver 31 and the activity station transceiver 41. Data collected can include, but is not limited to, game score, debits and credits, user identity, user demographic information, and/or time usage.

Preferably, the activity station 40 can also notify the management station 30 of various events, event criteria, or the absence of activity. This notification can be used to trigger predetermined events. For example, at random intervals or as prompted by reduced activity on a machine 100 as indicated by the activity station 40, the management station 30 can trigger a signal light 110 on the machine 100 indicating a period of a reduced operation price for that machine 100, e.g. 25 cents per play instead of one dollar per play. The management station 30 can also trigger signal lights 110 on a group of machines based on a total activity level indicated by the group. This feature can encourage game play on otherwise unused or under-used machines.

In addition to the above descriptions, the activity management system 10 can be used with a variety of activities, both coin-operated and not. Activity stations 40 can be placed at ticket booths of amusement park rides for ticketing purposes and to restrict access based on the variety of event criteria described above. Activity stations 40 can be placed on casino tables for non-coin operated gaming such as craps and blackjack to record bets and winnings. Activity stations 40 can be placed on vending machines.

In addition to the above descriptions, the event criteria placed on client transponder cards 20 can be used in a variety of ways. A customer location criterion can be placed on the card 20 so that the card 20 cannot be used at another location with a similar activity management system 10. This reduces the chance of debits/credits being moved out of the accounting system and used improperly at a different location.

A customer identification criterion can be placed on the card 20. Thus, customers can be given access (or restricted from access for "bad members," e.g. members with delinquent accounts) to various machines and locations on an individual basis. This criterion or a separate club criterion can also be used to indicate a club membership. Club membership can be associated with member benefits such as bonus debits/credits, frequent play debits/credits, and/or prizes.

A gaming group criterion can be placed on the card 20. Thus, customers can be given access (or restricted from access) to various machines on a machine group basis. For example, in an arcade and coin-operated batting cages facility, a customer's client transponder 20 could be restricted for use only with the batting cages. Access to the arcade would be denied.

A password criterion can be placed on the card 20 as well. When the activity station 40 reads the password criterion, it can require a pre-determined sequence of inputs to activate the machine 100 to which it is connected. For example, the password criterion may require a pre-determined card wave combination in front of the inductive transmission system 42. Alternatively, a keypad may be installed on the station 40 to require an alphanumeric password to be entered for activation of the machine 100. Another alternative is to use a biometric key based on, inter alia, a customer's fingerprint.

The activity management system 10 allows for novel uses of previously known coin-operated machines. For example, as opposed to a slot machine or video poker machine, a video arcade machine typically does not issue winnings to a customer for successful game play. However, with the activity management system 10, credits/debits can be issued from the activity station 40 to a client transponder card 20 based on game score and redeemed for prizes and/or currency.

Thus, an activity management system is described above that facilitates the accounting, maintenance and security of coins, bills and/or other currency and that does not require the user to leave his or her machine to return to a central location to acquire tokens, coins, or change for bills. The activity management system also provides access control and information to management to improve security, control cash flow, improve system management and accounting, and improve system monitoring. In each of the above embodiments, the different positions and structures of the present invention are described separately in each of the embodiments. However, it is the full intention of the inventor of the present invention that the separate aspects of each embodiment described herein may be combined with the other embodiments described herein. Those skilled in the art will appreciate that adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An activity management system comprising:

a client transponder with a memory unit containing at least one event criterion;

an activity station having an inductive transmission system for reading the client transponder and a memory unit containing a passkey program and a program for evaluating at least one event criterion in the client transponder; and an attendant transponder with a memory unit containing a passkey that accesses the passkey program in the activity station allowing the attendant transponder to cause the program in the memory unit of the activity station to change the event criterion in the client transponder next time the client transponder is read by the activity station.

2. The activity management system of claim 1 where the activity station has at least one status indicating light.

3. The activity management system of claim 1 where the activity station has an alphanumeric display.

4. The activity management system of claim 1 where at least one event criterion is a content rating.

5. The activity management system of claim 1 where at least one event criterion is a user age.

6. The activity management system of claim 1 where at least one event criterion is a debit/credit indicator.

7. The activity management system of claim 1 where at least one event criterion is a time stamp.

8. The activity management system of claim 1 further comprising a management station including a computer with a database, a transceiver and an inductive transmission system whereby the management station is connected with the activity station via the transceiver.

9. An activity management system comprising:

a client transponder with a memory unit, the memory unit having at least one event criterion and a debit and credit indicator;

an activity station having an inductive transmission system for reading the client transponder, and a memory unit, the memory unit containing an event criteria evaluating program for evaluating the event criteria in the client transponder, a passkey program and a debit and credit program;

an attendant transponder with a memory unit containing a passkey that accesses the passkey program in the activity station allowing the attendant transponder to cause the debit and credit program in the memory unit of the activity station to change the debit and credit indicator in the client transponder next time the client transponder is read by the activity station; and, a management station having a computer with a database, a transceiver and an inductive transmission system whereby the management station is connected with the activity station via the transceiver.

10. The activity management system of claim 9 where the activity station is connected to a coin mechanism of a video arcade machine.

11. The activity management system of claim 9 where the activity station is connected to a coin mechanism of a slot machine.

12. The activity management system of claim 9 where the activity station is connected to a coin mechanism of a vending machine.

13. The activity management system of claim 9 where the activity station is connected to a ticketing booth.

14. The activity management system of claim 9 where the activity station is connected to a coin mechanism of a coin-operated machine.

15. The activity management system of claim 9 where the client transponder is contained in a card.

16. The activity management system of claim 9 where the computer of the management station has a program for querying the activity station for data stored in the memory unit of the activity station.

17. The activity management system of claim 9 where the activity station has a call button.

18. The activity management system of claim 9 where the activity station notifies the management station via the inductive transmission system when at least one event criterion on the client transponder reaches a pre-determined level.

19. The activity management system of claim 9 where at least one event criterion is a customer identification.

20. The activity management system of claim 9 where at least one event criterion is a password criterion.

21. The activity management system of claim 9 where at least one event criterion is a club membership criterion.

22. The activity management system of claim 10 where the video arcade machine has a game score indicator and the activity station issues debits and credits to the client transponder based on the game score indicator.

23. The activity management system of claim 14 where the activity station further comprises a signal light for indication of a bonus state for the coin-operated machine.

24. The activity management system of claim 9 where the activity station is connected to a ticket dispenser.

25. The activity management system of claim 9 where the activity station is mounted on a casino table.

26. The activity management system of claim 9 where the activity station further comprises a keypad.

27. The activity management system of claim 9 where the activity station further comprises a biometric key entry system.

* * * * *